US010287086B2

(12) United States Patent
Huang

(10) Patent No.: US 10,287,086 B2
(45) Date of Patent: May 14, 2019

(54) ANTI-BREAKAGE AND ANTI-SCALD BOTTLE

(71) Applicant: Shen Zhen Xin Yue Tang Plastic & Hardware Co., Ltd, Shenzhen (CN)

(72) Inventor: Lihua Huang, Guangdong (CN)

(73) Assignee: Shen Zhen Xin Yue Tang Plastic & Hardware Co., Ltd, Shenzhen (CN)

( * ) Notice: Subject to any disclaimer, the term of this patent is extended or adjusted under 35 U.S.C. 154(b) by 0 days.

(21) Appl. No.: 15/871,130

(22) Filed: Jan. 15, 2018

(65) Prior Publication Data

US 2018/0134479 A1 May 17, 2018

(51) Int. Cl.

| | |
|---|---|
| ***A61J 9/00*** | (2006.01) |
| ***B65D 81/38*** | (2006.01) |
| ***B65D 8/00*** | (2006.01) |
| ***B65D 81/05*** | (2006.01) |
| *A61J 9/08* | (2006.01) |

(52) U.S. Cl.

CPC ..... *B65D 81/3841* (2013.01); *B65D 11/04* (2013.01); *B65D 81/053* (2013.01); *B65D 81/3846* (2013.01); *B65D 2203/00* (2013.01)

(58) Field of Classification Search

CPC .. B65D 81/3841; B65D 11/04; B65D 81/053; B65D 81/3846; B65D 2203/00

USPC ..... 215/12.1, 11.1, 11.2

See application file for complete search history.

(56) References Cited

U.S. PATENT DOCUMENTS

| | | | | |
|---|---|---|---|---|
| 3,866,782 | A * | 2/1975 | Westfall | B65D 45/30 215/253 |
| 4,746,017 | A * | 5/1988 | Howard | B65D 11/04 206/438 |
| 6,332,557 | B1 * | 12/2001 | Moran | A47J 41/0083 215/12.1 |
| 7,967,163 | B1 * | 6/2011 | Martin | B65D 25/54 215/11.1 |
| 8,783,490 | B2 * | 7/2014 | Gupta | A47J 36/027 220/23.87 |
| 2002/0030030 | A1 * | 3/2002 | Rees | A61J 9/02 215/11.2 |
| 2005/0211712 | A1 * | 9/2005 | Moran | A47J 41/0011 220/592.17 |
| 2011/0259843 | A1 * | 10/2011 | Wu | B65D 23/0885 215/12.1 |
| 2017/0225849 | A1 * | 8/2017 | Miros | A45F 3/18 |
| 2017/0305640 | A1 * | 10/2017 | Thompson | B65D 81/3841 |
| 2017/0349357 | A1 * | 12/2017 | Yu | B65D 1/0207 |
| 2017/0361012 | A1 * | 12/2017 | Parker | A61M 3/0237 |

* cited by examiner

*Primary Examiner* — J. Gregory Pickett
*Assistant Examiner* — Niki M Eloshway
(74) *Attorney, Agent, or Firm* — Gokalp Bayramoglu

(57) ABSTRACT

An anti-breakage and anti-scald bottle includes an inner container and a plastic jacket arranged outside the inner container in a sleeving mode, wherein a soft rubber retainer ring is arranged at the inner bottom of the plastic jacket, and the bottom end of the inner container is clamped on the soft rubber retainer ring; an opening of the plastic jacket is connected with a fixed sleeve in a threaded mode, the neck of the fixed sleeve abuts against the periphery of an opening of the inner container, a soft rubber ring is fixedly arranged on the inner surface of the neck of the fixed sleeve and makes contact with the opening of the inner container, and a top opening of the fixed sleeve is sealed and covered with a bottle cap.

7 Claims, 3 Drawing Sheets

ANTI-BREAKAGE AND ANTI-SCALD BOTTLE

BACKGROUND OF THE INVENTION

Technical Field

The invention relates to water bottles, in particular to an anti-breakage and anti-scald bottle good in breakage resistance, not prone to scalding hands, safe, reliable, attractive and practical.

Description of Related Art

Water bottles are daily necessities in wide use and are generally used for containing water or other liquid and usually carried with people so that people can drink water conveniently. Existing water bottles are made of ceramic or glass or plastic, water bottles made of ceramic and glass are prone to being damaged by collisions or being broken, water bottles made of rubber are not prone to being damaged by collisions or being broken, but not suitable for containing high-temperature liquid, and consequentially, the increasing using requirements of people cannot be met.

BRIEF SUMMARY OF THE INVENTION

For overcoming the defects of the prior art, the invention aims to provide an anti-breakage and anti-scald bottle which is good in breakage resistance, not prone to scalding the hands, safe, reliable, attractive and practical.

According to the technical scheme of the invention, an anti-breakage and anti-scald bottle comprises an inner container and a plastic jacket arranged outside the inner container in a sleeving mode, wherein a soft rubber retainer ring is arranged at the inner bottom of the plastic jacket, and the bottom end of the inner container is clamped on the soft rubber retainer ring; an opening of the plastic jacket is connected with a fixed sleeve in a threaded mode, the neck of the fixed sleeve abuts against the periphery of an opening of the inner container, a soft rubber ring is fixedly arranged on the inner surface of the neck of the fixed sleeve and makes contact with the opening of the inner container, and a top opening of the fixed sleeve is sealed and covered with a bottle cap.

As a preferred scheme, a plurality of inner convex parts extend inwards from the inner surface of the soft rubber retainer ring, and the inner convex parts make contact with the outer surface of the inner container; a plurality of outer U-shaped convex parts extend outwards from the outer surface of soft rubber retainer ring, and the outer U-shaped convex parts make contact with the inner surface of the plastic jacket.

As a preferred scheme, the inner container is a glass inner container, a ceramic inner container or a purple clay inner container.

As a preferred scheme, a circular wristlet is arranged at the top of the bottle cap.

As a preferred scheme, n-shaped protrusions are arranged on the outer surface of the fixed sleeve.

As a preferred scheme, the plastic jacket is a transparent jacket.

As a preferred scheme, a temperature-sensitive ink layer is printed on the outer surface of the inner container.

As a preferred scheme, a signing area is arranged on the outer surface of the inner container.

According to the anti-breakage and anti-scald bottle of the invention, the plastic jacket is arranged outside the inner container in the sleeving mode, the soft rubber retainer ring is arranged at the inner bottom of the plastic jacket, the fixed sleeve is arranged at the opening of the plastic jacket, the inner container is clamped between the soft rubber retainer ring and the neck of the fixed sleeve, the soft rubber ring making contact with the opening of the inner container is arranged on the inner surface of the neck of the fixed sleeve, in this way, when the bottle is impacted by a large external force, the plastic jacket can effectively prevent the inner container from being damaged by the collision or being broken, the soft rubber retainer ring and the soft rubber ring can fix the inner container and can also achieve a good buffering effect, and thus the breakage resistance of the bottle is greatly improved; in addition, when hot water is contained in the inner container, the plastic jacket can insulate heat, and thus the hands of a user are protected against scalds when the user holds the bottle. The anti-breakage and anti-scald bottle of the invention has the advantages of being good in breakage resistance, not prone to scalding hands, safe and reliable.

DETAILED DESCRIPTION OF THE INVENTION

Figure 1:
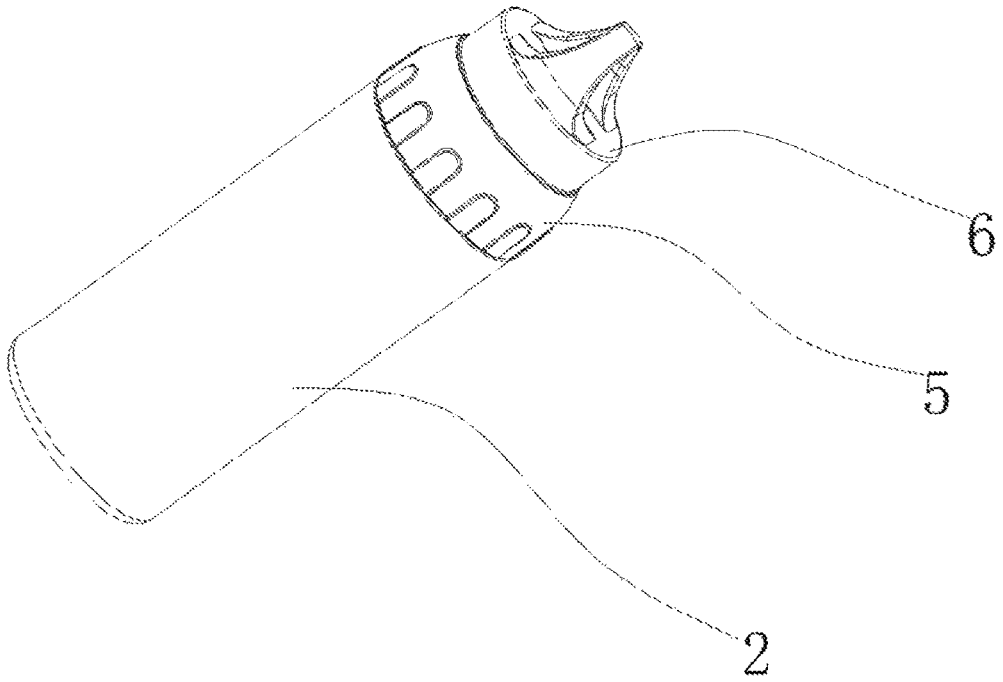
FIG. 1 is a structural diagram of an embodiment of the invention.

A further detailed description of the invention is given with embodiments and accompanying drawings as follows.

As is shown in FIGS. 1-5, an anti-breakage and anti-scald bottle comprises an inner container 3 and a plastic jacket 2 arranged outside the inner container 3 in a sleeving mode, wherein a soft rubber retainer ring 1 is arranged at the inner bottom of the plastic jacket 2, and the bottom end of the inner container 3 is clamped on the soft rubber retainer ring 1; an opening of the plastic jacket 2 is connected with a fixed sleeve 5 in a threaded mode, the neck of the fixed sleeve 5 abuts against the periphery of an opening of the inner container 3, and a soft rubber ring 4 is fixedly arranged on the inner surface of the neck of the fixed sleeve 5 and makes contact with the opening of the inner container 3; a top opening of the fixed sleeve 5 is sealed and covered with a bottle cap 6, and the inner container is a glass inner container, a ceramic inner container or a purple clay inner container.

According to the anti-breakage and anti-scald bottle, the plastic jacket 2 is arranged outside the inner container 3 in the sleeving mode, the soft rubber retainer ring 1 is arranged at the inner bottom of the plastic jacket 2, the fixed sleeve 5 is arranged at the opening of the plastic jacket 2, the bottom of the inner container 3 is clamped on the soft rubber retainer ring 1, the top opening of the inner container 3 abuts against the top of the fixed sleeve 5, the soft rubber ring 4 making contact with the opening of the inner container 3 is arranged on the inner surface of the neck of the fixed sleeve 5, in this way, when the bottle is impacted by large external force, the plastic jacket 2 can effectively prevent the inner container 3 from being damaged by collisions or being broken, the soft rubber retainer ring 1 and the soft rubber ring 4 can fix the inner container 3 and can also achieve a good buffering effect, and thus the breakage resistance of the bottle is greatly improved; in addition, when hot water is contained in the inner container 3, the plastic jacket 2 can insulate heat, and thus hands are prevented from being scalded by the bottle; liquid at different temperatures can be contained in the plastic jacket 2 and the inner container 3, liquid in the inner container 3 is heated or cooled through heat transfer, and thus the bottle can be used more conveniently.

Figure 3:
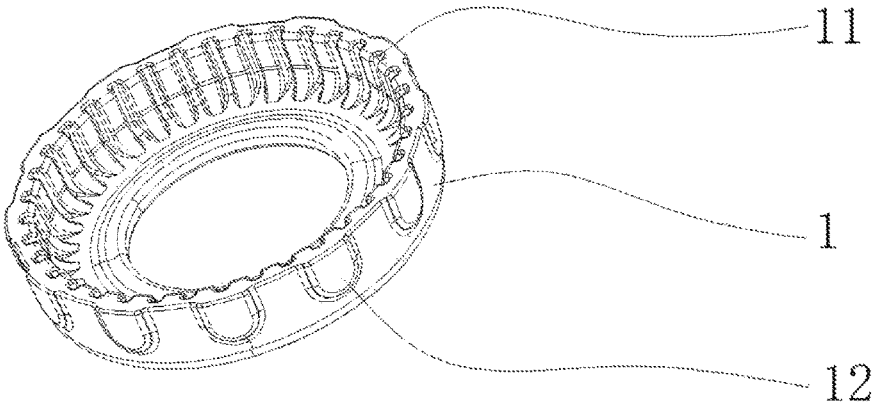
FIG. 3 is a structural diagram of a soft rubber retainer ring in the embodiment of the invention.

As is shown in FIG. 3, particularly for the anti-breakage and anti-scald bottle based on the above technical scheme in one embodiment, a plurality of inner convex parts 11 extend inwards from the inner surface of the soft rubber retainer ring 1, and the inner convex parts 11 make contact with the outer surface of the inner container 3; a plurality of outer U-shaped convex parts 12 extend outwards from the outer surface of soft rubber retainer ring 1, and the outer U-shaped convex parts 12 make contact with the inner surface of the plastic jacket 2; in this way, the soft rubber retainer ring 1 and the plastic jacket 2 make contact with the inner container 3 more tightly, the inner container 3 is fixed more firmly, and thus the breakage resistance of the inner container 3 is improved.

Figure 2:
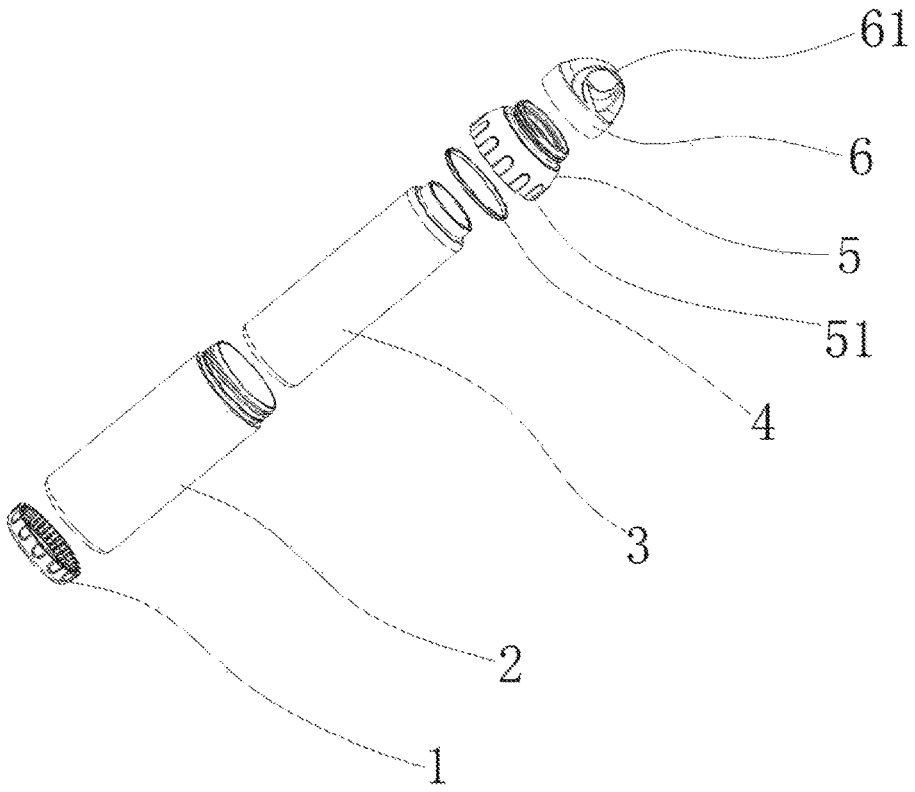
FIG. 2 is a structural breakdown diagram of the embodiment of the invention.

As is shown in FIG. 2, particularly for the anti-breakage and anti-scald bottle based on the above technical scheme in one embodiment, a circular wristlet 61 is arranged at the top of the bottle cap 6, and for holding the wristlet 61 conveniently, a decorative string can be threaded through the wristlet 61, and thus the water bottle can be carried conveniently.

Figure 4:
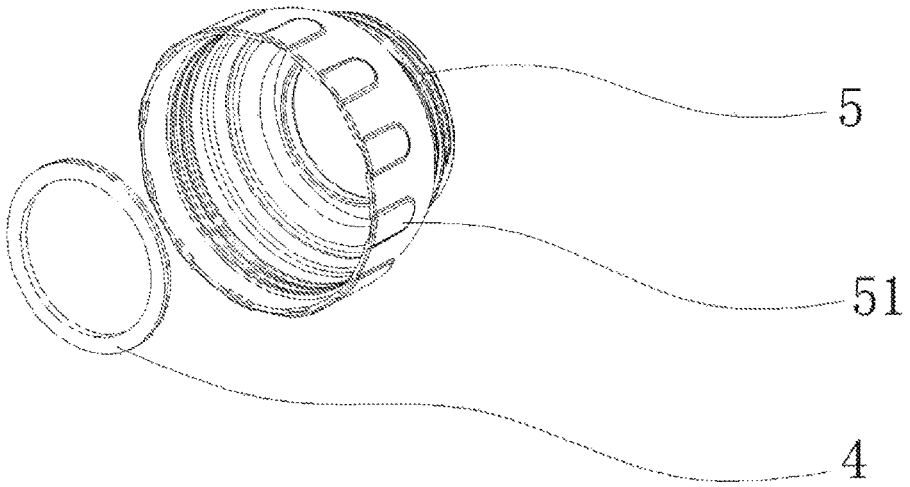
FIG. 4 is a structural diagram of a fixed sleeve and a soft rubber ring in the embodiment of the invention.
Figure 5:
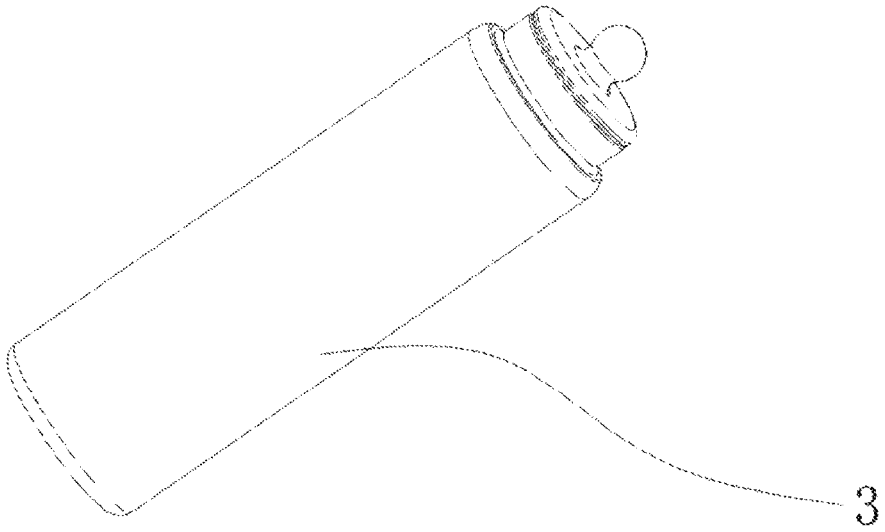
FIG. 5 is a structural diagram of an inner container covered with a cap when used independently in the embodiment of the invention.

As is shown in FIG. 4, particularly for the anti-breakage and anti-scald bottle based on the above technical scheme in one embodiment, n-shaped protrusions 51 are arranged on the outer surface of the fixed sleeve 5 so that the fixed sleeve 5 can be screwed off conveniently for taking out or placing in the inner container 3, accordingly, inner containers 3 in different colors can be conveniently adopted, and the attractiveness of the bottle is improved; the inner container 3 can also be matched with a cap after being taken out, the soft rubber retainer ring 1 in the plastic jacket 2 is taken out, and thus the anti-breakage and anti-scald bottle can be used as two bottles flexibly and conveniently.

As is shown in FIG. 1, particularly for the anti-breakage and anti-scald bottle based on the above technical scheme in one embodiment, the plastic jacket 2 is a transparent jacket so that liquid in the inner container 3 can be observed conveniently, liquid can be added in time when the amount of liquid in the inner container is small, and meanwhile, the attractiveness of the bottle is improved.

As is shown in FIG. 2, particularly for the anti-breakage and anti-scald bottle based on the above technical scheme in one embodiment, a temperature-sensitive ink layer is printed on the outer surface of the inner container 3, and thus the temperature of liquid in the inner container can be sensed in real time; when the temperature-sensitive ink layer is red, it indicates that liquid in the inner container is hot; when the temperature-sensitive ink layer is yellow, it indicates that the liquid in the inner container is warm; when the temperature-sensitive ink layer is blue, it indicates that liquid in the inner container is at the normal temperature; in this way, the interestingness and practicability of the anti-breakage and anti-scald bottle are improved.

As is shown in FIG. 2, particularly for the anti-breakage and anti-scald bottle based on the above technical scheme in one embodiment, a signing area is arranged on the outer surface of the inner container 3, characters in the signing area can be erased and changed, and the user can sign in the signing area, so that the bottle is prevented from being confused with other bottles or getting lost; characters used for expressing moods can also be written in the signing area, and thus the interestingness of the bottle is further improved. Of course, in other embodiments, a transparent interlayer can be arranged on the plastic jacket 2, a photo of the user or a card with the name of the user is placed in the transparent interlayer, and thus the owner of the bottle can be recognized.

An illustration of the anti-breakage and anti-scald bottle of the invention is given above and used for assisting in understanding the invention, however, the execution modes of the invention are not limited to the above embodiments, and any equivalent substitute modes such as changes, modifications, substitutes, combinations and simplifications made without deviating from the principle of the invention are within the protection scope of the invention.

What is claimed is:

1. An anti-breakage and anti-scald bottle, comprising an inner container and a plastic jacket arranged outside the inner container in a sleeving mode, wherein a soft rubber retainer ring is arranged at an inner bottom of the plastic jacket, and a bottom end of the inner container is fixed on the soft rubber retainer ring; an opening of the plastic jacket is connected with a fixed sleeve in a threaded mode, a neck of the fixed sleeve abuts against the periphery of an opening of the inner container, a soft rubber ring is fixedly arranged on an inner surface of the neck of the fixed sleeve and makes contact with the opening of the inner container, and a top opening of the fixed sleeve is sealed and covered with a bottle cap;

wherein a plurality of inner convex parts extend inward from an inner surface of the soft rubber retainer ring, and the inner convex parts make contact with an outer surface of the inner container; more than two outer U-shaped convex parts extending outward from an outer surface of the soft rubber retainer ring, and the outer U-shaped convex parts make contact with the inner surface of the plastic jacket.

2. The anti-breakage and anti-scald bottle according to claim 1, wherein the inner container is a glass inner container, a ceramic inner container or a purple clay inner container.

3. The anti-breakage and anti-scald bottle according to claim 1, wherein a circular wristlet is arranged at the top of the bottle cap.

4. The anti-breakage and anti-scald bottle according to claim 1, wherein n-shaped protrusions are arranged on an outer surface of the fixed sleeve.

5. The anti-breakage and anti-scald bottle according to claim 4, wherein a temperature-sensitive ink layer is printed on an outer surface of the inner container.

6. The anti-breakage and anti-scald bottle according to claim 1, wherein the plastic jacket is a transparent jacket.

7. The anti-breakage and anti-scald bottle according to claim 1, wherein a signing area is arranged on the outer surface of the inner container.

* * * * *